United States Patent [19]
Koike
[11] 4,244,259
[45] Jan. 13, 1981

[54] ELECTRONIC MUSICAL INSTRUMENT WITH MEMORY TO STORE TONE CONTROL INFORMATION

[75] Inventor: Masahiko Koike, Hamamatsu, Japan

[73] Assignee: Nippon Gakki Seizo Kabushiki Kaisha, Hamamatsu, Japan

[21] Appl. No.: 54,428

[22] Filed: Jul. 3, 1979

[30] Foreign Application Priority Data

Jul. 10, 1978 [JP] Japan ..... 53-94858
Jul. 25, 1978 [JP] Japan ..... 53-102021

[51] Int. Cl.³ ..... G10H 3/00
[52] U.S. Cl. ..... 84/1.19; 84/1.01; 84/462
[58] Field of Search ..... 84/1.01, 1.03, 1.19, 84/1.24, 461–463, DIG. 29, 1.28, 115

[56] References Cited

U.S. PATENT DOCUMENTS

| | | | |
|---|---|---|---|
| 3,829,597 | 8/1974 | Peterson et al. | 84/462 |
| 3,905,267 | 9/1975 | Vincent | 84/462 |
| 3,935,781 | 2/1976 | Katoh et al. | 84/1.19 |
| 3,999,458 | 12/1976 | Suzuki | 84/1.24 |
| 4,023,456 | 5/1977 | Groeschez | 84/115 |
| 4,046,047 | 9/1977 | Roberts | 84/1.01 |
| 4,056,683 | 11/1977 | Suehiro | 84/1.01 |
| 4,088,051 | 5/1978 | Ellen | 84/1.24 |
| 4,135,428 | 1/1979 | Campbell | 84/462 |
| 4,147,083 | 4/1979 | Woron et al. | 84/1.03 |
| 4,185,531 | 1/1980 | Oberheim | 84/1.19 X |

FOREIGN PATENT DOCUMENTS 52-154620 6/1977 Japan .

*Primary Examiner*—Gene Z. Rubinson
*Assistant Examiner*—Forester W. Isen
*Attorney, Agent, or Firm*—Frishauf, Holtz, Goodman & Woodward

[57] ABSTRACT

An electronic musical instrument is capable of processing, by the same processing circuit, parameter control analog information signals defining the shape of control waveforms for the modulation of musical tone signals, and analog musical tone signal generation mode select signals for selecting, for example, a musical tone signal waveform and filter characteristic. The parameter control analog information signals and generation mode analog select signals are both optionally set by a player and are multiplexed in a time sharing manner by an analog multiplexer. The multiplexed analog signals are converted into digital signals, which are converted into analog signals, and further demultiplexed. In a write mode, the digital signals are stored in a memory, while, in a read mode, the digital signals are read out of the memory, converted into analog signals, and demultiplexed. The demultiplexed parameter control analog signals are coupled to control waveform generator circuits, and the analog select signals are coupled to voltage detector circuits to have their analog voltage levels detected. The generation mode of a musical tone signal depends on voltage levels of the analog select signals.

10 Claims, 10 Drawing Figures

CONTROL PANEL
51
52
MUSICAL TONE CONTROL INFOR-MATION SOURCES
OPERATION CONTROL CKT 53
PSSi
PSSi2
PAS
WRS
VI1 (OMS)
VI47
MULTIPLEXER
54
OSC.
56
CK2
COUNTER LATCH
57
COMP.
EQ
55
D/A CONVERTER
58
61
MEMORY (RAM'S)
R/W
E
D
60
DEMULTIPLE-XER
59
VO1 (OMS)
VO47
EXTERNAL MEMORY
65
62
DME
ROD
RRW
RCE
A/D CL
A/D D
ADDRESS GEN.
63
ADD CL
CK1
CONTROL SIGNAL GEN.
64
FI
EO1~EO6
APS
PAL
WRT

ELECTRONIC MUSICAL INSTRUMENT WITH MEMORY TO STORE TONE CONTROL INFORMATION

BACKGROUND OF THE INVENTION

This invention relates to an electronic musical instrument, and more particularly to a music synthesizer type electronic instrument with a memory to store musical tone modulation control information and musical tone signal generation mode select information.

Generally known are music synthesizers that are provided with a voltage-controlled oscillator (VCO), a voltage-controlled filter (VCF), and a voltage-controlled amplifier (VCA). In a conventional music synthesizer, control waveforms generators are provided for producing musical tone signals rich in music expression. A control waveform generated by the control waveform generator and having a magnitude varying with time is coupled to each of VCF and VCA so that the frequency characteristic of VCF and the gain of VCA vary with time. In other words, the musical tone signal is modulated in its tone color and volume envelope. The control waveform may be coupled also to VCO so that the tone pitch of the musical tone signal may also vary with time. It is to be desired that the shape of the control waveform can be changed voluntarily by the player. Therefore, the control waveform generators are so designed that their control waveform parameters such as attack time, first decay time, sustain level, second decay time, etc. may be arbitrarily determined by parameter control analog signals externally applied thereto. The parameter control analog signals are provided by potentiometers connected across a power source and located in easy positions for the player to operate. During a performance, however, it is almost impossible for the player to change the shape of control waveforms by operating a plurality of potentiometers to change the modulation control mode for a musical tone signal being produced. Accordingly, a prior art synthesizer is provided with a multiplexer, analog-to-digital (A/D) converter, random access memory (RAM), digital-to-analog (D/A) converter, and the preset switches. The preset switches are adapted to select memory blocks in a RAM. In a storage mode, a set of parameter control analog signals are multiplexed in a time sharing manner in a regular sequence. The multiplexed analog signals are converted successively into digital signals by the A/D converter, and stored in a memory block of the RAM designated by an operated preset switch. In a read mode, a set of parameter control digital signals are read out successively from a memory block of the RAM corresponding to an operated preset switch, and converted successively into analog signals by the D/A converter. The time shared analog signals are then demultiplexed by a demultiplexer, and the demultiplexed analog signals are coupled to corresponding input terminals of a control waveform generator. According to such an electronic instrument, sets of control analog signals as many as the preset switches are stored in the RAM. Even during the performance, therefore, the player can voluntarily select the modulation control mode for a musical tone signal by only selecting a preset switch.

For improved music expression, besides increased faculties of modulation control of musical tone signals by control waveforms, a music synthesizer is required to have a function of selecting the generation modes of the tone signals. By such a generation mode select function, one of waveforms of a tone signal from VCO, for example, may optionally be selected, and a VCF may be set to any one of high-pass, band-pass, and low-pass filters. In the aforementioned prior art electronic musical instrument, generation mode select information is provided by a combination of on- and off-states of generation mode select switches, that is, by a multi-bit digital signal. A set of parameter control information signals and generation mode select information signals corresponding to one preset switch may be stored in a common RAM. Unlike the parameter control information signal, however, the generation mode select information signal is given in the form of a digital signal consisting of on-off combinations of the select switches, so that the analog multiplexer and demultiplexer for the parameter control information signals cannot be used for the generation mode select information signals. Thus, a digital multiplexer and a demultiplexer are additionally used for the generation of mode select information signals, requiring two signal processing systems and thereby complicating the construction of the instrument.

SUMMARY OF THE INVENTION

An object of this invention is to provide an electronic musical instrument of simple construction with a memory to store musical tone control information.

Another object of this invention is to provide an electronic musical instrument of the above-mentioned type which is capable of processing by a single processing system musical tone control signals for musical tone controls of different types.

Still another object of this invention is to provide an electronic musical instrument of the above-mentioned type which is capable of monitoring, when presetting musical tone control information into a memory, musical tones controlled by the musical tone control information to be stored in the memory.

According to this invention, musical tone signal generation mode select signals used for selection of musical tone signal waveforms and filters are given as analog voltage signals each having one of multi-levels of voltage, whereby parameter control analog signals to define the shape of control waveforms and the analog generation mode select signals may be processed by a common signal processing circuit.

DETAILED DESCRIPTION OF THE PREFERRED EMBODIMENT

Figure 1A:
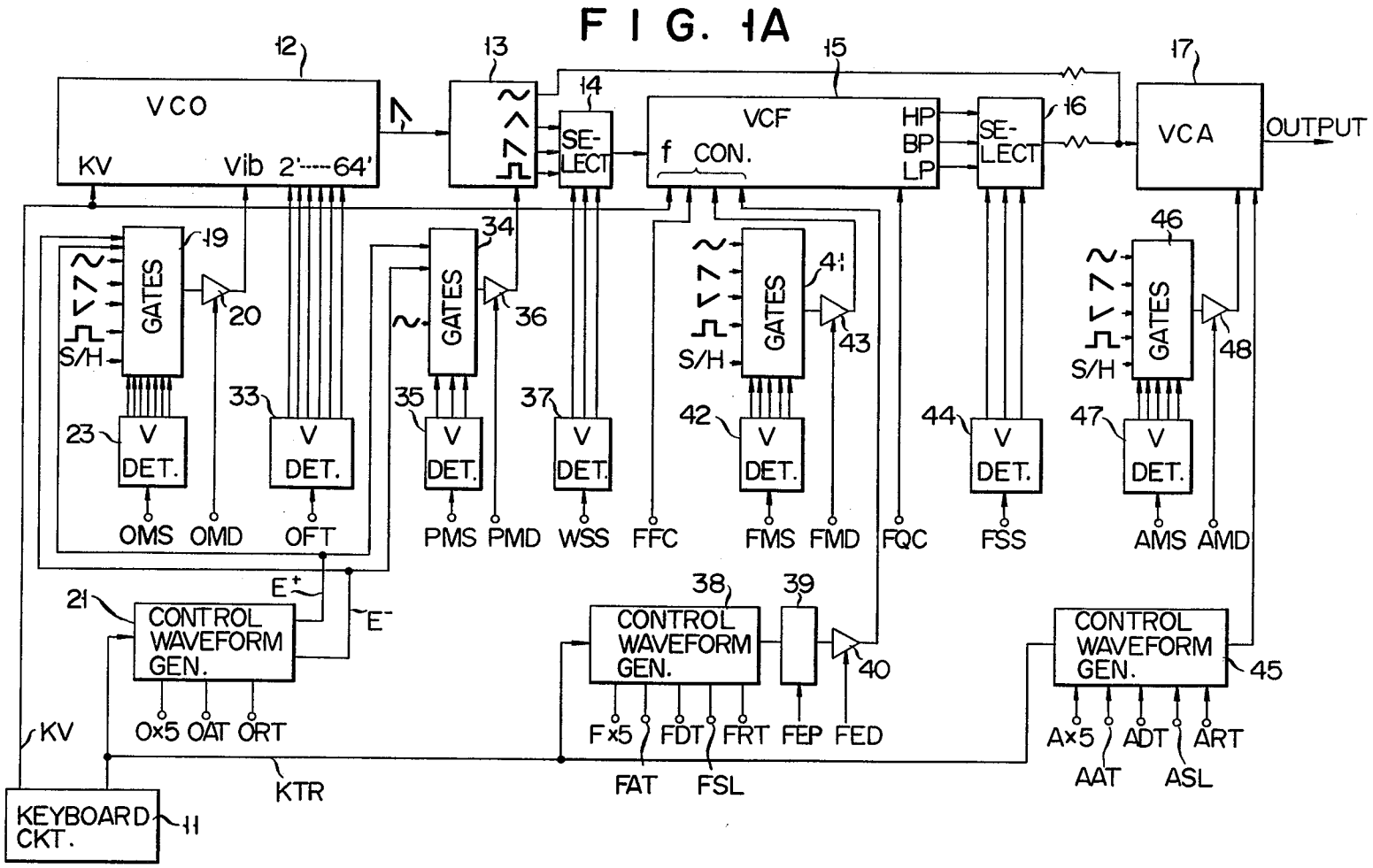
FIGS. 1A and 1B show, in combination, an electronic musical instrument embodying this invention.
Figure 1B:
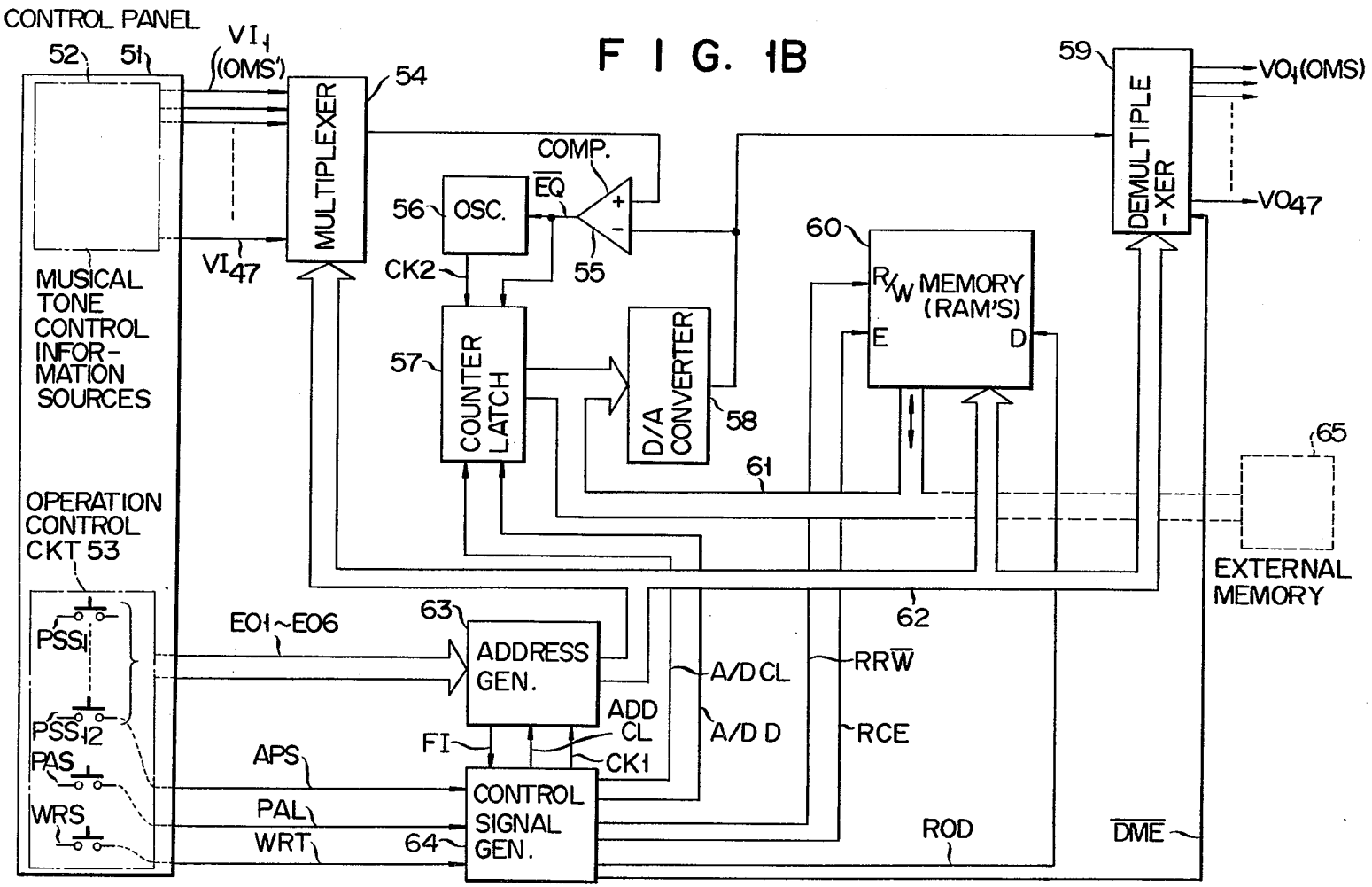

Referring now to FIGS. 1A and 1B showing an embodiment of this invention, a keyboard circuit 11 produces in response to depression of a key a key identifying signal KV having a magnitude corresponding to the note of the key being depressed and a trigger signal KTR lasting from key depression till key release. The key identifying signal KV is supplied to VCO 12, which thereby produces a tone signal at a frequency conrresponding to the note of the depressed key. At a wave shaper circuit 13, the tone signal is converted into sine wave, triangular wave, sawtooth wave, and rectangular wave tone signals. If the tone signal of VCO 12 is a sawtooth wave signal, the output signal of VCO 12 is directly used as the sawtooth wave output signal of the wave shaper circuit 13. The triangular wave, sawtooth wave, and rectangular wave tone signals containing different harmonic components are applied to a select gate circuit 14, where one of those three tone signals is selected and delivered to VCF 15. VCF 15 includes a high-pass filter HP, band-pass filter BP, and a low-pass filter LP, one of which is selected by a select gate circuit 16. The output tone signal of the select gate circuit 16 is mixed with the sine wave output signal of the wave shaper circuit 13, and coupled to VCA 17. The output signal of VCA 17 is coupled to a sound system (not shown).

Figure 2:
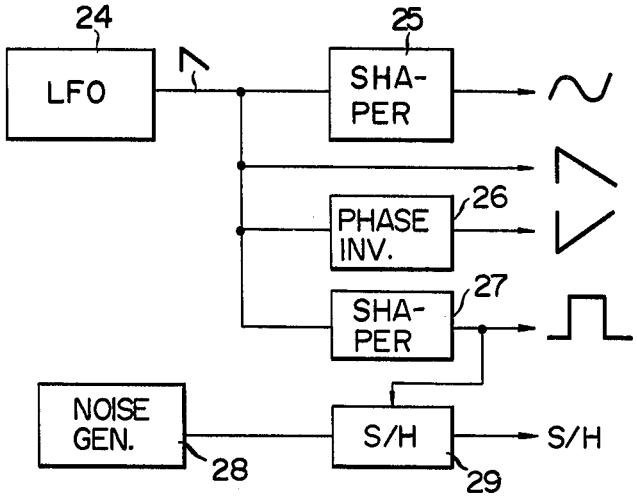
FIG. 2 shows a low-frequency oscillator circuit.
Figure 3:
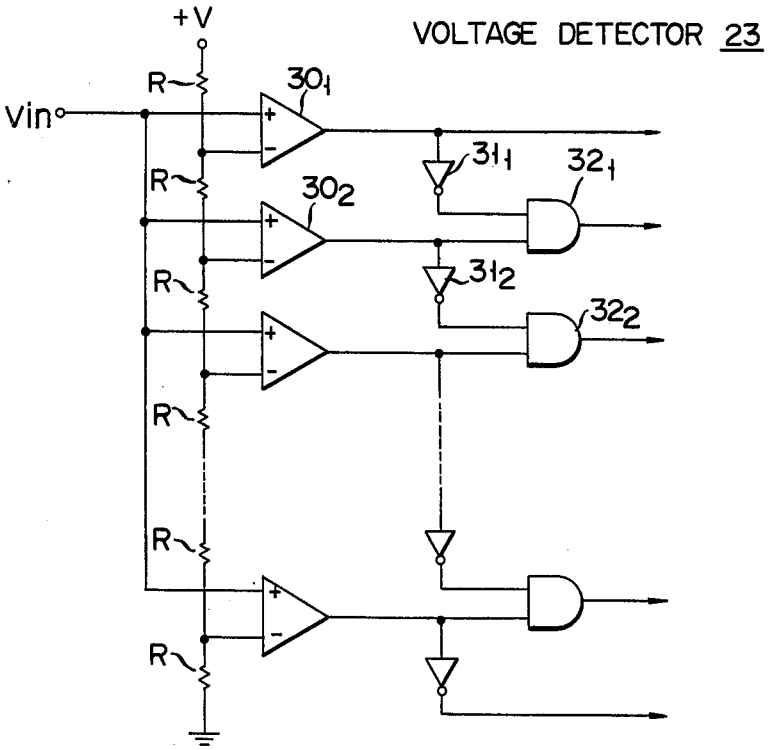
FIG. 3 shows a practical arrangement of a voltage detector circuit as shown in FIG. 1A.

The above-mentioned musical tone signal synthesizing circuit is supplied with various musical tone control information signals. A modulation signal selected by a select gate circuit 19 is applied to a modulation input terminal Vib of VCO 12. Available for the modulation signal are control waveform signal $E^+$ and a polarity-inverted control waveform signal $E^-$ from a control waveform generator 21, a sine wave signal, sawtooth wave signal, polarity-inverted sawtooth wave signal, rectangular wave signal, and a sample and hold signal S/H obtained by sampling and holding a white noise from a low-frequency oscillator circuit section as shown in FIG. 2. Several AND gates in the select gate circuit 19 are coupled with outputs of a voltage detector circuit 23 as shown in FIG. 3, while the voltage detector 23 is supplied with an effect select signal OMS. The effect select signal OMS, in this example, can selectively take one of seven levels of voltage. The voltage detector 23 detects the voltage level of the signals OMS, bringing its output corresponding to such a voltage level to a high level, i.e. logical "1" level. An AND gate in the select gate circuit 19 connected to the output that is brought to the high level is enabled, and a modulation signal coupled to the enabled AND gate is supplied to VCO 12.

The low frequency oscillator circuit section, as shown in FIG. 2, is comprised of a low frequency sawtooth wave oscillator 24, wave shaper 25 for converting the sawtooth wave signal into sine wave signal, inverter circuit 26 for inverting the polarity of the sawtooth wave signal, wave shaper 27 for converting sawtooth wave signal into rectangular wave signal, white noise generator 28, and a sample and hold circuit 29 sampling with the rectangular wave output of the wave shaper 27 an envelope obtained by rectifying a white noise signal from the white noise generator 28. The amplitude of output signal S/H of the sample and hold circuit 29 fluctuates at random.

As shown in FIG. 3, the voltage detector circuit 23 includes a plurality of comparators $30_1$, $30_2$, . . . which are supplied in parallel with an input voltage Vin such as the select signal OMS, and are respectively supplied with divided voltages of a voltage divider circuit connected across a power source +V and formed of resistors R, as comparison input signals. The outputs of the comparators $30_2$, $30_3$, . . . are coupled respectively to AND gates $32_1$, $32_2$, . . . , which are coupled also with outputs of inverters $31_1$, $31_2$, . . . , as illustrated. In such an arrangement, if the input voltage Vin is higher than the comparison input voltage of the comparator $30_1$, the output of all the comparators will go high. Since the AND gates $32_1$, $32_2$, . . . are disabled by low level outputs of the inverters $31_1$, $31_2$, . . . , however, the outputs of all the AND gates are rendered low. Accordingly, only the AND gate of the select gate circuit 19 that is coupled to the output of comparator $30_1$ is enabled. Thus, the circuit comprising the inverters $31_1$, $31_2$, . . . and AND gates $32_1$, $32_2$, . . . constitutes a priority logic circuit which produces a logical "1" output at a selected output corresponding to the level of the input voltage Vin. Voltage detector circuits mentioned later are also constructed in a similar manner shown in FIG. 3.

The control waveform generator 21 is coupled with analog signals OAT and ORT for controlling parameters such as attack time and decay time after key release or release time of control waveform, and with a select signal 0×5 having one of two different voltage levels and switching the time parameters of the control waveform between T and 5×T.

If the control waveform $E^+$ or $E^-$ is coupled to VCO 12 by the select signal OMS, the tone pitch of the tone signal is modulated in accordance with the shape of the control waveform. When the signal from the low frequency oscillator circuit section is selected, the oscillation frequency of VCO 12 periodically changes to provide a vibrato effect. The deviation of the oscillation frequency of VCO 12 is controlled by a gain-variable buffer amplifier 20 which is supplied with a modulation degree control analog signal OMD.

Feet selection of the tone signal of VCO 12 is made by a voltage detector circuit 33 which is supplied with a feet select signal OFT having one of six voltage levels.

The control waveforms $E^+$ and $E^-$ from the control waveform generator circuit 21, as well as the sine wave signal from the low-frequency oscillator circuit, are supplied to a select gate circuit 34. One of input signals of the select gate circuit 34 is selected by a voltage detector circuit 35 which responds to a select signal PMS having one of three voltage levels. The amplitude of the selected input signal is controlled by a buffer amplifier 36 whose gain is controlled by an analog signal PMD, and supplied to the wave shaper circuit 13 for modulation of pulse width of the rectangular wave tone signal. The select gate circuit 14 performs select operation in accordance with the output state of a voltage detector circuit 37 which responds to a select signal WSS having one of three voltage levels.

A control waveform generator circuit 38 is provided for VCF 15. This circuit 38 is coupled with a time setting signal F×5 for switching time parameters of the control signal, attack time control analog signal FAT, first decay time control analog signal FDT, sustain level control analog signal FSL, and a second delay time control analog signal FRT. In response to the key trigger signal KTR, the control waveform generator circuit 38 produces a control waveform having parameters determined by the magnitudes of those parameter control analog signals. The polarity of the control waveform is selected by a polarity selector circuit 39 which responds to a polarity select signal FEP. The amplitude of the control waveform is controlled by a buffer amplifier 40 responsive to an analog signal FED, and the control waveform is coupled to VCF 15. VCF 15 is coupled also with an output signal from the low-frequency oscillator circuit through a select gate circuit 41 responsive to a voltage detector circuit 42 which is supplied with a select signal FMS having one of five voltage levels and a buffer amplifier 43 whose gain is controlled by an analog signal FMD. VCF 15 is further coupled with the key identifying signal or pitch determining voltage signal KV from the keyboard circuit 11 and an analog signal FFC. The control waveform, low-frequency control signal, pitch determining voltage signal KV, and the analog control signal FFC are mixed in the VCF 15, and modulate the frequency characteristic or cut-off frequency or frequencies of VCF 15. By impression of the low-frequency signal, the cut-off frequency of VCF 15 may be changed periodically. VCF 15 is also supplied with an analog signal FQC for controlling the resonance of filters. The select operation of the select gate circuit 16 for the HP, BP and LP outputs depends on the output state of a detector circuit 44 for detecting the voltage level of a select signal FSS having one of three voltage levels.

VCA 17 is coupled with a control waveform from a control waveform generator 45, as its gain control signal. The control waveform generator 45 is coupled with a time select signal A×5 for the time parameters of the control waveform, the signal A×5 having one of two voltage levels, attack time control analog signal AAT, first decay time control analog signal ADT, sustain level control analog signal ASL, and a second delay time control analog signal ART. Moreover, VCA 17 is supplied with, as another gain control signal, a signal from the low-frequency oscillator circuit section through a select gate circuit 46 responsive to a voltage detector circuit 47 which is supplied with a select signal AMS having one of five voltage levels and a buffer amplifier 48 which responds to a gain control analog signal AMD. The low-frequency control signal provides a tremolo effect, and the depth of tremolo is controlled by the control analog signal AMD.

Figure 4:
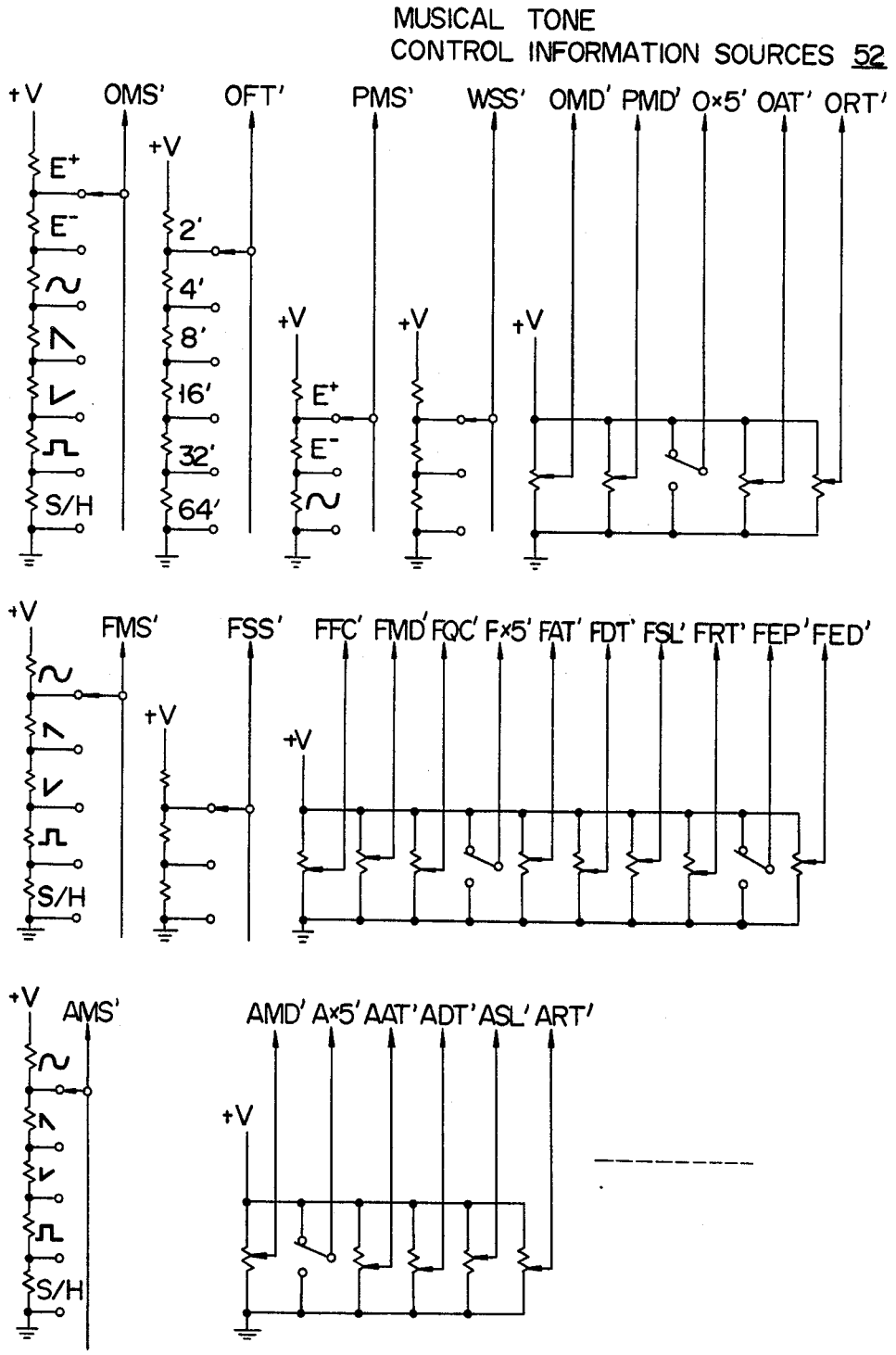
FIG. 4 shows a practical arrangement of musical tone control information sources as shown in FIG. 1B.

The control mode of a musical tone signal produced by thus constructed electronic musical instrument is determined by the settings of the magnitudes of the control analog signals and the voltage levels of the select signals each having one of multi-voltage levels. The settings of the voltage levels of the control analog signals are performed on the control panel of the electronic musical instrument. The settings of magnitudes of the analog signals OAT, ORT, FAT, FDT, etc. are achieved by slider adjustments of potentiometers connected across a power source, as shown in FIG. 4, whereas the voltage level settings for the select signals OMS, OFT, PMS, WSS, FMS, FSS and AMS having one of three or more voltage levels are accomplished by tap selection by means of changeover switches connected to voltage dividers. The voltage level settings for the select signals 0×5, F×5 and A×5 each having one of two voltage levels are achieved by means of a single-pole douple throw switch connected across the power source. In FIG. 4, primes are attached to the symbols of control signals because these control signals, according to this invention, are coupled to the circuit as shown in FIG. 1A not directly but only after processing such as A/D and D/A conversions, as mentioned later. It is to be noted that FIGS. 1A and 4 do not show all pieces of musical tone control information. For example, the low-frequency oscillator 24 may be coupled with frequency control information and amplitude control information. Further, an additional VCO may be provided whose output is coupled to VCF 15. As may be seen from the description below, the embodiment of the invention can cover as many as 47 pieces of control information.

FIG. 1B shows a processing circuit for processing musical tone control signals from musical tone control information sources 52 of a control panel section 51 in accordance with operation control signals from an operation control circuit 53. Control signals VII (OMS'), VI2 (OFT'), . . . VI47 from the musical tone control information sources 52 are applied in parallel to an analog multiplexer 54, where they are multiplexed in time sharing manner. The multiplexed musical tone control signals are coupled to the noninverting input of a comparator circuit 55. The inverting input of the comparator circuit 55 is coupled with the output of a D/A converter 58 mentioned later.

An output EQ of the compartor circuit 55 is normally at a high voltage level or logic "1" level, enabling a clock oscillator 56 to oscillate. A clock signal CK2 from the oscillator 56, together with the output EQ of comparator 55, is coupled to a counter and latch circuit 57. The counter counts the number of clock signals CK2, and the count number in the counter is latched in the latch circuit for every count of a clock signal. A multibit output digital signal from the latch circuit is coupled to the inputs of the D/A converter 58. An output analog voltage of the D/A converter 58 changes stepwisely; when it becomes higher than the multiplexed analog voltage at the noninverting input of comparator 55, the output EQ of comparator 55 goes low to disable the oscillator 56 and the counter and latch circuit 57. The output of counter and latch circuit 57 at this point of time corresponds to the digital value of the multiplexed analog signal coupled to the comparator 55. This digital value is converted into an analog signal by the D/A converter 58, demultiplexed by a demultiplexer 59, and appears at a predetermined output of the demultiplexer 59. In a write mode, the output digital value of counter and latch circuit 57 corresponding to the multiplexed analog signal is loaded through a data bus 61 into a predetermined location of a memory 60 formed of RAM's, for example. In a read mode, digital signals stored in the memory 60 are read out in succession, converted into analog signals by the D/A converter 58, and then demultiplexed by the demultiplexer 59. Outputs VO1 (OMS) to VO47 of the demultiplexer 59 are coupled to their corresponding control terminals shown in FIG. 1A.

In FIG. 1B, the digital conversion of the multiplexed analog signal is achieved with the assistance of D/A converter 58, so that the circuit arrangement is simplified. In other words, a D/A converter that is usually incorporated in an A/D converter is used for the D/A converter 58 for conversion of digital signals of the A/D converter into analog signals. It is to be understood that a D/A converter may be provided separately from the A/D converter.

Transmission of the musical tone control information and writing in and reading out from the memory are performed by means of the operation control circuit 53 in the control panel section 51, an address generator 63, and a control signal generator 64. The operation control circuit 53 is provided with preset switches PSS1 to PSS12, panel switch PAS, and write switch WRS as described in detail hereinafter. When one of the preset switches is turned on, a 6-bit digital signal specifying the preset switch is produced and supplied to the address generator 63. 6-bit digital signals designate memory blocks of the memory 60 corresponding to the preset switches PSS1 to PSS12. Each memory block has 47 locations which store 47 words. The address generator 63 successively produces address signals for designating 47 memory locations in a memory block corresponding to the selected preset switch which store 47 pieces of musical tone control information, in response to the 6-bit digital signal and a clock signal CK1 from the control signal generator 64. The address signals are coupled to address input terminals of the memory 60 via an address bus 62. In response to the clock signal CK1, the address generator 63 produces an address signal or control signal to operate the multiplexer 54 and demultiplexer 59 synchronously. The control signal generator 64 provides several control signals A/D CL (A/D CLEAR), A/D D (A/D DISABLE), RRW (RAM READ WRITE), RCE (RAM CHIP ENABLE), ROD (RAM OUTPUT DISABLE), DME (DEMULTIPLEXER ENABLE) and ADD CL (ADDRESS CLEAR) in response to a signal PAL indicating the operation of panel switch PAS, a signal WRT indicating the operation of write switch WRS, and a signal APS indicating the operation of any one of the preset switches PSS1 to PSS12 that are delivered from the operation control circuit 53. The control signal generator 64 receives from the address generator 63 an address finish signal FI indicating the completion of address designation for all the locations of one memory block. An external memory 65 may be used as required, in combination with the internal memory 60.

Depending on the operation state of the switches of the operation control circuit 53, the electronic musical instrument is set to any one of panel, write and read modes. If the panel switch PAS alone is operated, the instrument is set to the panel mode for a musical performance in a control mode set by the musical tone control information sources 52. If one preset switch and the write switch WRS are operated, the instrument is set to the write mode, and the digital-converted musical tone control information is stored in the locations of a memory block of the memory 60 corresponding to the operated preset switch. 12 sets of musical tone control information corresponding to the 12 preset switches PSS1 to PSS12 can be stored in their corresponding memory blocks. If a preset switch alone is operated, the electronic musical instrument is set to the read mode or performance mode, musical tone control information is read out of a memory block of the memory 60 corresponding to the operated preset switch, and a performance is achieved in a control mode based on the read musical tone control information. If another preset switch is operated, then the musical performance will be given in accordance with a control mode corresponding to such a preset switch.

The following point may be given as one of the advantages of this invention. The musical tone control mode may be set in the panel mode on the musical tone control information sources 52 while monitoring the performance. In this panel mode, analog information from the musical tone control information sources 52 is multiplexed, analog-to-digital converted, digital-to-analog converted, demultiplexed, and then coupled to the musical tone signal synthesizing circuit of FIG. 1A. If one preset switch and the write switch WRS are operated at a point of time when the control mode is set as desired, the electronic musical instrument is switched from the panel mode to the write mode. In consequence, the digital control information is stored in a block of the memory 60 designated by the operated preset switch. In the read mode, the digital control information read out of the memory 60 is digital-to-analog converted, and then demultiplexed. This means that the performance is achieved in the performance mode with the same control mode as in the panel mode without being influenced by conversion errors accompanying the analog-to-digital conversion and digital-to-analog conversion. According to the prior art electronical musical instrument as aforesaid, the musical tone control analog information provided by potentiometers is coupled directly to the musical tone signal synthesizing circuit in the panel mode, and, in the write mode, it is multiplexed, analog-to-digital converted, and stored in the memory. In the performance mode, the digital control information read out of the memory is digital-to-analog converted, demultiplexed, and coupled to the musical tone signal synthesizing circuit. Therefore, the analog control information coupled to the musical tone signal synthesizing circuit in the panel mode would be different from the analog control information coupled to the circuit in the performance mode due to the conversion errors involved in the analog-to-digital conversion and digital-to-analog conversion. This means that musical tones may not be produced as expected in the performance mode.

Figure 5:
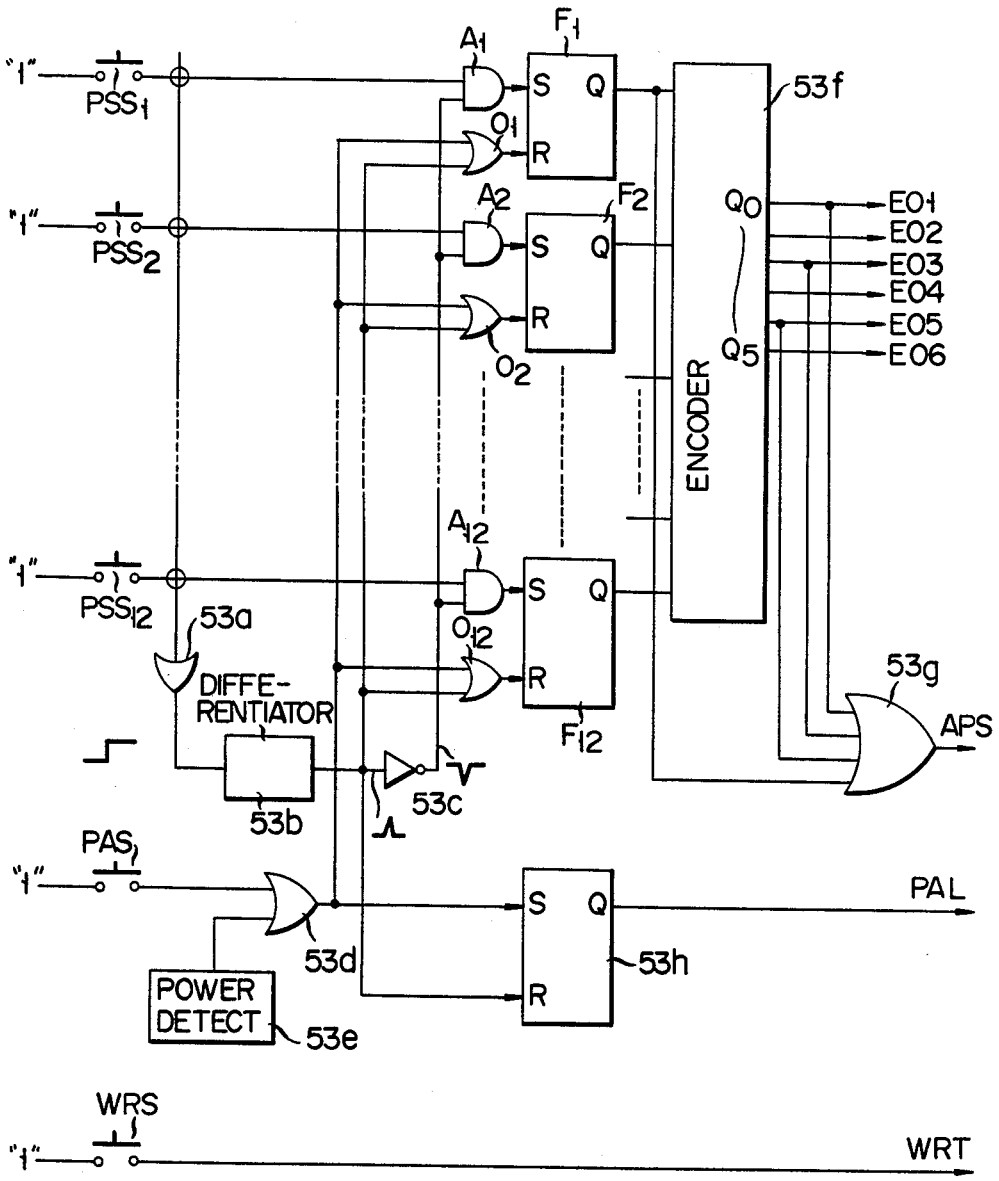
FIG. 5 shows a practical arrangement of an operation control circuit as shown in FIG. 1B.

The operation control circuit 53 of FIG. 1B may be so constructed as shown in FIG. 5. The preset switches PSS1 to PSS12 are disposed respectively between a voltage source of the logic "1" level and AND gates A1 to A12. The outputs of AND gates A1 to A12 are coupled to set terminals S of flip-flop circuits F1 to F12, respectively. The output of preset switches PSS1 to PSS12 is coupled through an OR gate **53*a* to a differentiator 53*b* to detect the rise of output voltage of the OR gate 53*a*. The output of the differentiator 53*b* is coupled to the AND gates A1 to A12 through an inverter 53*c*. The panel switch PAS is interposed between the logic "1" level power source and an OR gate 53*d*. The OR gate 53*d* is coupled with the output of a power detector circuit 53*e*. The output of the OR gate 53*d* is coupled to OR gates 01 to 012 whose outputs are coupled to reset terminals R of the flip-flop circuits F1 to F12, respectively. The OR gates 01 to 012 are coupled also with the output of differentiator 53*b*. Outputs Q of the flip-flop circuits F1 to F12 are coupled to an encoder 53*f*, providing a 6-bit address signal E01 to E06 to designate a memory block corresponding to the operated preset switch. The output Q of the flip-flop circuit F1 and outputs Q0, Q2 and Q4 of the encoder 53*f* are coupled to an OR gate 53*g*, producing the logic "1" level signal APS which indicates a state that any one of the preset switches PSS1 to PSS12 is on. The output of the OR gate 53*d* is coupled to a set terminal S of a flip-flop circuit 53*h*, producing the logic "1" level signal PAL when the panel switch PAS is on or when the power supply is first applied to the instrument. A reset terminal R of the flip-flop circuit 53***h* is coupled with the output of the differentiator 53*b*. When the write switch WRS is on, the logic "1" level signal WRT is produced.

When one of the preset switches PSS1 to PSS12 in the operation control circuit is operated, all the flip-flop circuits F1 to F12 are reset at the rise of output pulse of the differentiator 53*b*, and only a flip-flop circuit corresponding to the operated preset switch is set to render its output high at the fall of the output pulse. As a result, the encoder 53*f* delivers a digital signal to represent the operated preset switch. When the panel switch PAS is operated, all the flip-flop circuits F1 to F12 are reset. Thus, the flip-flop circuit 53*h* is set to render the signal PAL high, thereby indicating the operation of the panel switch PAS. When the power supply is first applied to the instrument, the flip-flop circuit 53*h* is set, and the flip-flop circuits F1 to F12 are reset. The flip-flop circuit 53*h* is reset by the operation of any one of the preset switches PSS1 to PSS12.

The relationships between the preset switches PSS1 to PSS12 and the voltage levels at the outputs Q0 to Q5 of the encoder 53*f* are shown in Table I.

TABLE I

| | Q0 | Q1 | Q2 | Q3 | Q4 | Q5 |
|---|---|---|---|---|---|---|
| PSS1 | 0 | 0 | 0 | 0 | 0 | 0 |
| PSS2 | 1 | 1 | 0 | 0 | 0 | 0 |
| PSS3 | 0 | 1 | 1 | 0 | 0 | 0 |
| PSS4 | 1 | 0 | 0 | 1 | 0 | 0 |
| PSS5 | 0 | 0 | 1 | 1 | 0 | 0 |
| PSS6 | 1 | 1 | 1 | 1 | 0 | 0 |
| PSS7 | 0 | 1 | 0 | 0 | 1 | 0 |
| PSS8 | 1 | 0 | 1 | 0 | 1 | 0 |
| PSS9 | 0 | 0 | 0 | 1 | 1 | 0 |
| PSS10 | 1 | 1 | 0 | 1 | 1 | 0 |
| PSS11 | 0 | 1 | 1 | 1 | 1 | 0 |
| PSS12 | 1 | 0 | 0 | 0 | 0 | 1 |

As may be seen from Table I, the memory block designating address signal E01 to E06 from the encoder 53*f* increases from PSS1 to PSS12 by 110000 (=48) for every preset switch.

Figure 6:
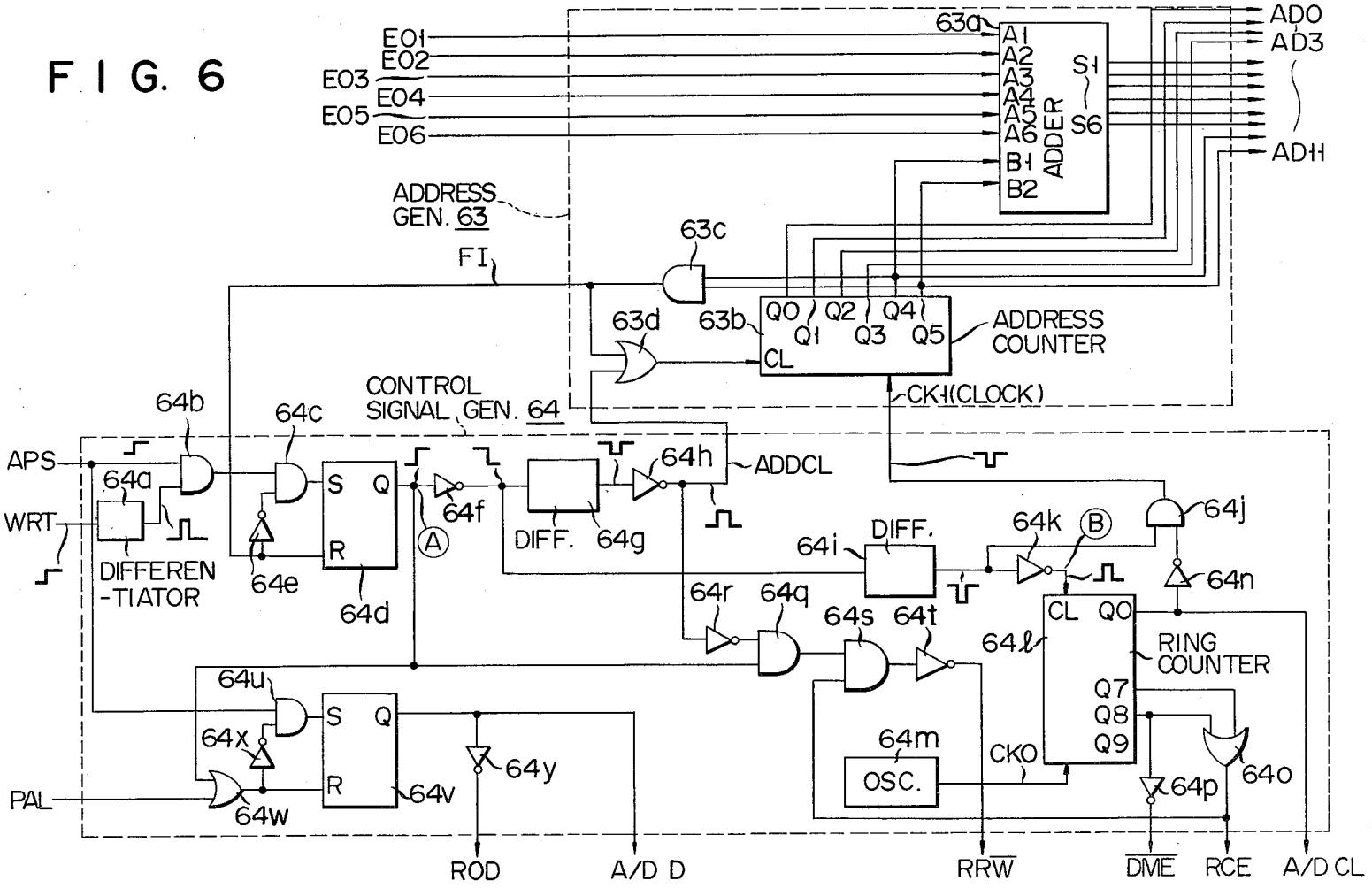
FIG. 6 shows practical arrangements of an address generator and a control signal generator circuit as shown in FIG. 1B.

The 6-bit address signal E01 to E06 of the encoder 53*f* is coupled to inputs A1 to A6 of an adder 63*a* of the address generator 63 as shown in FIG. 6, where upper significant bits Q4 and Q5 of an address counter 63*b* consisting of six cascade-connected binary counters for counting the clock signals CK1 from the control signal generator 64, which are coupled to inputs B1 and B2 of the adder 63*a*, are added to the upper significant bits E01 and E02 of the address signal.

The bit outputs Q4 and Q5 of the address counter 63*b* are coupled to an AND gate 63*c*, whose output is coupled to the clear terminal of address counter 63*b* through an OR gate 63*d*. Consequently, the address counter 63*b* is cleared for every count of 48 clock signals CK1. 6 bit outputs S1 to S6 of the adder 63*a* and 6 bit outputs Q0 to Q5 of the address counter 63*b* are used as address signals AD0 to AD11. More specifically, the signals AD0 to AD3 are the outputs Q0 to Q3 of the address counter 63*b*, respectively, AD4 to AD9 are the outputs S1 to S6 of the adder 63*a*, respectively, and AD10 and AD11 are the upper significant bit outputs Q4 and Q5 of the address counter 63*b*, respectively. AD0 to AD9 are used as address signal for the memory, while AD0 to AD3 and AD10 and AD11 are employed as address signal or control signal for the multiplexer 54 and demultiplexer 59. By this address generator 63, the 47 locations of a memory block designated by the operated preset switch are successively accessed.

In the control signal generator 64, the write switch operating signal WRT from the operation control circuit 53 is coupled to a differentiator 63*a*, producing a positive-going output pulse in synchronism with the rise of the signal WRT. The preset switch operating signal APS is coupled to an AND gate 64*b* which is coupled with the output of the differentiator 64*a*. The output of AND gate 64*b* is coupled to a set terminal S of a flip-flop circuit 64*d* through an AND gate 64*c*. A reset terminal R of the flip-flop circuit 64*d* is coupled with the address designation finish signal FI from the address generator 63, and the signal FI is coupled also to the AND gate 64*c* through an inverter 64*e*. That is, the flip-flop circuit 64*d* is set at the beginning of the write mode, and reset when the writing of control information into a memory block is finished.

An output Q of the flip-flop circuit 64*d* is coupled to a differentiator 64*g* through an inverter 64*f*, providing a negative-going output pulse in synchronism with the fall of the output voltage of the inverter 64*f*. The negative-going pulse of the differentiator 64*g* is inverted by an inverter 64*h*, and then applied as a clear pulse to the clear terminal CL of the address counter 63*b* via the OR gate 63*d*. That is, the address counter 63*b* is cleared at the beginning of the write mode. The output of the inverter 64*f* is coupled to a differentiator 64*i*, producing a negative-going pulse in synchronism with the fall of the output voltage of the inverter 64*f*. The negative-going output pulse of the differentiator 64*i* is coupled through an inverter 64*k* to a clear terminal CL of a ring counter 64*l* having outputs Q0 to Q9 for counting clocks CK0 from a clock generator 64*m*. Namely, the ring counter 64*l* is cleared to have its output Q0 go high at the beginning of the write mode. The output Q0 of counter 64*l* is coupled through an inverter 64*n* to an AND gate 64*j* which is coupled with the output of the differentiator 64*i*. A negative-going output pulse from the AND gate 64*j* is supplied as the clock signal CK1 to the address counter 63*b*. A positive-going signal at the output Q0 of the ring counter 64*l* is used as the signal A/D CL for clearing the A/D converter. Positive-going signals at the outputs Q7 and Q8 are delivered as the RAM chip enable signal RCE through an OR gate 64*o*. Further, a negative-going output signal of an inverter 64*p* connected to the output Q8 is used as the signal DME for enabling the demultiplexer 59.

The output Q of flip-flop circuit 64*d* is coupled to an AND gate 64*q*, which is coupled also with the output of an inverter 64*r* to which the output of the inverter 64*h* is connected. The output of AND gate 64*q* is coupled to an AND gate 64*s*, which is coupled also with the output of OR gate 64*o*. The output of AND gate 64*s* is coupled to an inverter 64*t* to produce the control signal RRW for the read/write operation of the memory. The output of AND gate 64*q* is normally at logic level "0", so that the signal RRW is normally at the logic "1" level, setting memory to the read mode. In the write mode, the output of AND gate 64*q* becomes the logic "1" level, so that the output of AND gate 64*s* is turned to the logic "1" level for a period of time that the output of OR gate 64*o* is at the logic "1" level or the RAM chip is enabled. Namely, while the RAM chip is enabled in the write mode, the signal RRW is reduced to the logic "0" level, setting the memory to the write mode.

Further, the preset switch operating signal APS is coupled through an AND gate 64*u* to a set terminal S of a flip-flop circuit 64*v*, whose reset terminal R is coupled with the panel switch operating signal PAL through an OR gate 64*w*. The OR gate 64*w* is coupled also with the output Q of flip-flop circuit 64*d*. The output of OR gate 64*w* is coupled to the AND gate 64*u* through an inverter 64*x*. The flip-flop circuit 64*v* is set to have its output Q go high in the performance mode where the preset switch alone is operated. In the write and panel modes, the flip-flop circuit 64*v* is reset. The output Q of flip-flop circuit 64*v* and the output of an inverter 64*y* connected to the output Q are used as the signals A/D D and RCD, respectively. Accordingly, in the performance mode that the flip-flop circuit 64*v* is set, the signal A/D D is brought to the logic "1" to disable the A/D conversion. On the other hand, the signal RCD is at a logic "0" level, enabling the data readout from RAM. In the panel and write modes, the flip-flop circuit 64*v* is reset to bring the signal A/D D to the logic "0" level, enabling the A/D conversion. As for the signal RCD, it is at the logic "1" level, disabling the output of RAM to prohibit the data readout therefrom.

Figure 7:
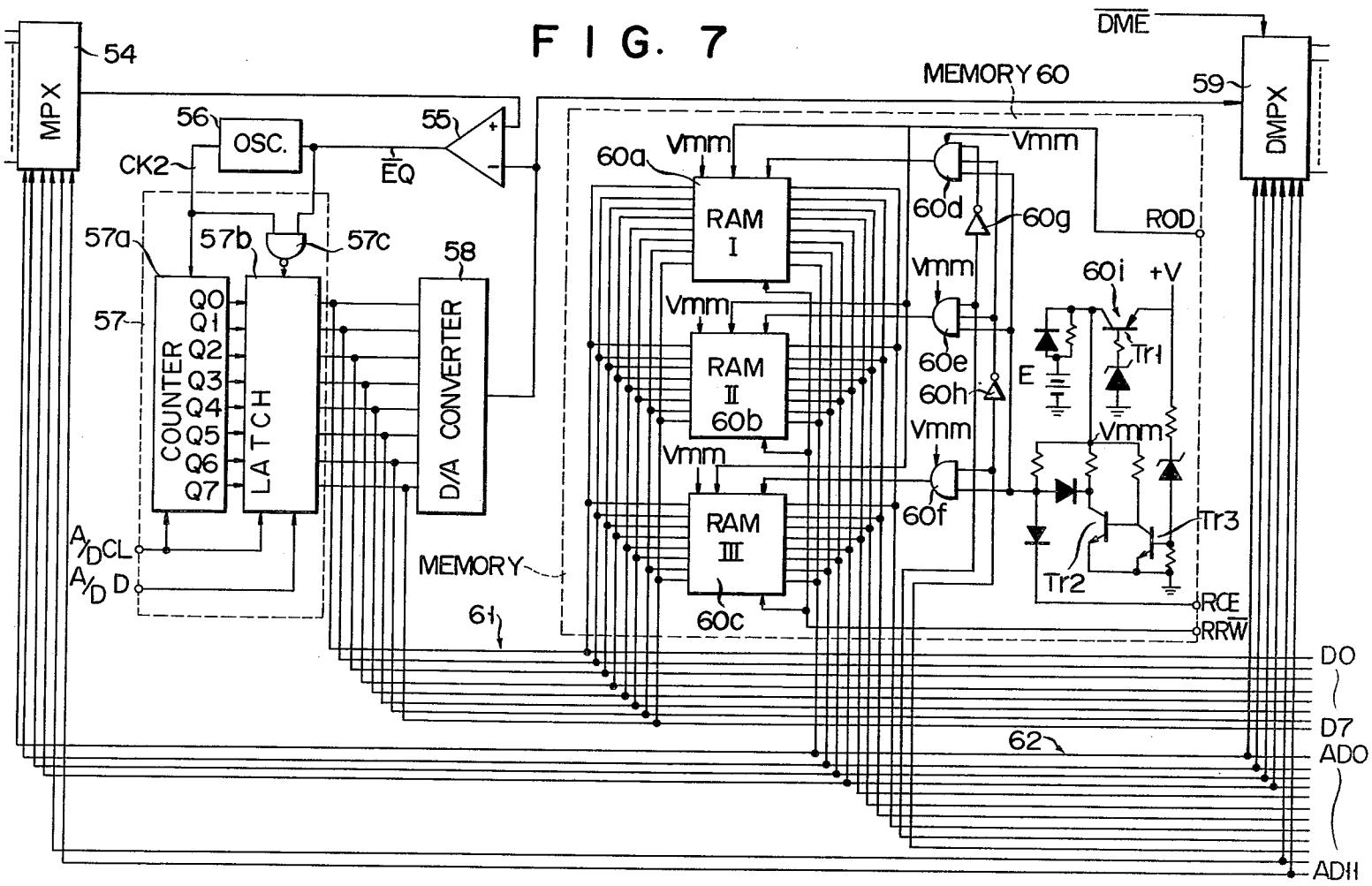
FIG. 7 shows practical arrangements of a counter and latch circuit and a memory as shown in FIG. 1B, especially.

FIG. 7 shows the counter and latch circuit 57 and the memory 60 in detail. The analog control information from the musical tone control information sources 52 is multiplexed in time sharing manner by the multiplexer 54 under the control of address signals AD0 to AD3 and AD10 and AD11 provided by the address counter 63*b*.

The clock signals CK2 from the clock oscillator 56, having frequency much higher than that of the clocks CK1 supplied to the address counter 63*b*, are counted by a counter 57*a* with 8 bit outputs Q0 to Q7. The outputs Q0 to Q7 of counter 57*a* are coupled to a latch circuit 57*b*. The latch circuit 57*b* is coupled with, as a latch control signal, an output signal from a NAND gate 57*c* which is coupled with the output EQ of the comparator 55 and the clock CK2, the output signal from NAND gate 57*c* being opposite to the clock CK2 in polarity. Thus, immediately after the counter 57*a* has counted one clock CK2, the latch circuit 57*b* latches the count in the counter 57*a*. The counter 57*a* and the latch circuit 57*b* are cleared by the signal A/D CL of logic "1" level. The latch circuit 57*b* has its output disabled by the signal A/D D of logic "1" level so that the count value may be derived therefrom. The 8 bit outputs of the latch circuit are coupled to the D/A converter 58 and the memory 60 by means of the data bus 61. The D/A converter 58, which may be a weighted-resister D/A converter, has its output coupled to the demultiplexer 59. Like the multiplexer 54, the demultiplexer 59 operates under the control of address signal AD0 to AD3 and AD10 and AD11 in synchronism with the multiplexer 54.

The memory 60 comprises RAM chips 60*a*, 60*b* and 60*c*. The RAM chips 60*a* and 60*b* each have memory capacity of 256 words each of 8 bits, while the RAM chip 60*c* has memory capacity of at least 64 words each of 8 bits. The data terminals of these RAM chips are connected to the outputs of counter and latch circuit 57 and the inputs of D/A converter 58 by means of the data bus 61 (D0 to D7). The address terminals of each of the RAM chips are coupled with the address signal AD0 to AD7 by means of the address bus 62. The RAM chips are each supplied with the RAM output disable signal ROD and the RAM read/write control signal RRW. AND gates 60*d*, 60*e* and 60*f* and inverters 60*g* and 60*h* select one of the RAM chips 60*a*, 60*b* and 60*c* in response to the signals AD8 and AD9 on the address bus 62. The RAM chip 60*a* is selected when AD8 and AD9 are 0 and 0 respectively, while the RAM chip 60*b* is selected when AD8 and AD9 are 1 and 0 respectively, and the RAM chip 60*c* is selected when AD9 is 1.

In order not to erase stored contents in the RAM chips when the power source (+V) is turned off, the RAM chips 60*a*, 60*b* and 60*c* and the AND gates 60*d*, 60*e* and 60*f* are supplied with a supply voltage Vmm from a back-up power source 60*i*. When the power source (+V) is on, a transistor Tr1 is on, and Vmm (≈+V) is taken out from the collector of transistor Tr1. When the power source (+V) is off, a battery voltage E, which is a little lower than +V, is taken out from the collector of transistor Tr1. Transistors Tr2 and Tr3 are off and on, respectively, when the power source (+V) is on, so that the back-up power source 60*i*, which is connected to the AND gates 60*d*, 60*e* and 60*f*, enables these AND gates. When the power source (+V) is off, the transistors Tr2 and Tr3 are on and off, respectively, so that the AND gates 60*d*, 60*e* and 60*f* are disabled. Moreover, the RAM chip enabled signal RCE is coupled to the back-up power source 60*i*, enabling the AND gates 60*d*, 60*e* and 60*f* only when it is at the logic "1" level, during the time the power source (+V) is on. That is, the RAM chip can be selected only during the RAM chip enable period.

Table II shows the relationships between the address signals of the preset switches and the memory addresses.

TABLE II

| PRESET SWITCHES | ADDRESS SIGNAL (AD0 to AD9) | ADDRESSES |
|---|---|---|
| PSS1 | 0000000000 to 1111010000 | 0 to 47 |
| PSS2 | 0000110000 to 1111101000 | 48 to 95 |
| PSS3 | 0000011000 to 1111000100 | 96 to 143 |
| PSS4 | 0000100100 to 1111110100 | 144 to 191 |
| PSS5 | 0000001100 to 1111011100 | 192 to 239 |
| PSS6 | 0000111100 to 1111100010 | 240 to 287 |
| PSS7 | 0000010010 to 1111001010 | 288 to 336 |
| PSS8 | 0000101010 to 1111111010 | 337 to 384 |
| PSS9 | 0000000110 to 1111010110 | 385 to 432 |
| PSS10 | 0000110110 to 1111101110 | 433 to 480 |
| PSS11 | 0000011110 to 1111000001 | 481 to 528 |
| PSS12 | 0000100001 to 1111110001 | 529 to 575 |

Figure 8:
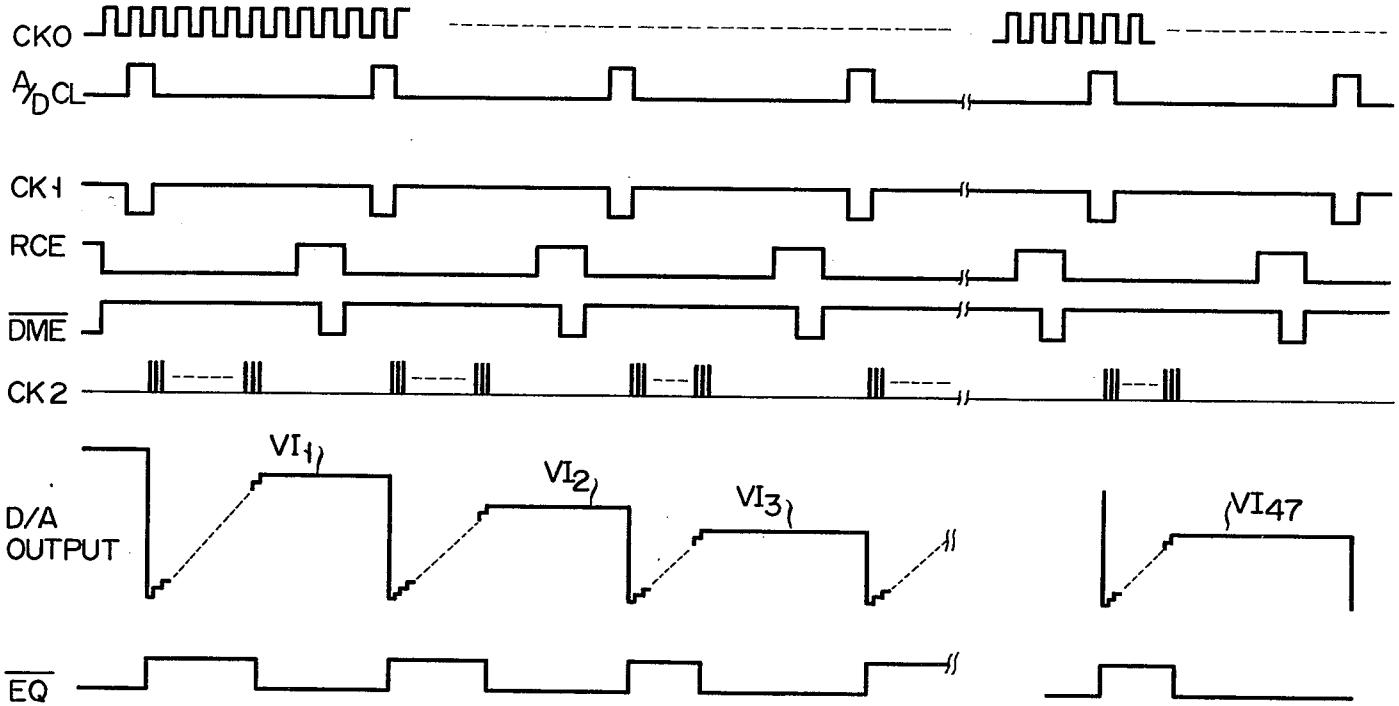
FIG. 8 shows waveforms useful in explaining the operation of the electronic musical instrument of the invention in a panel mode.
Figure 9:
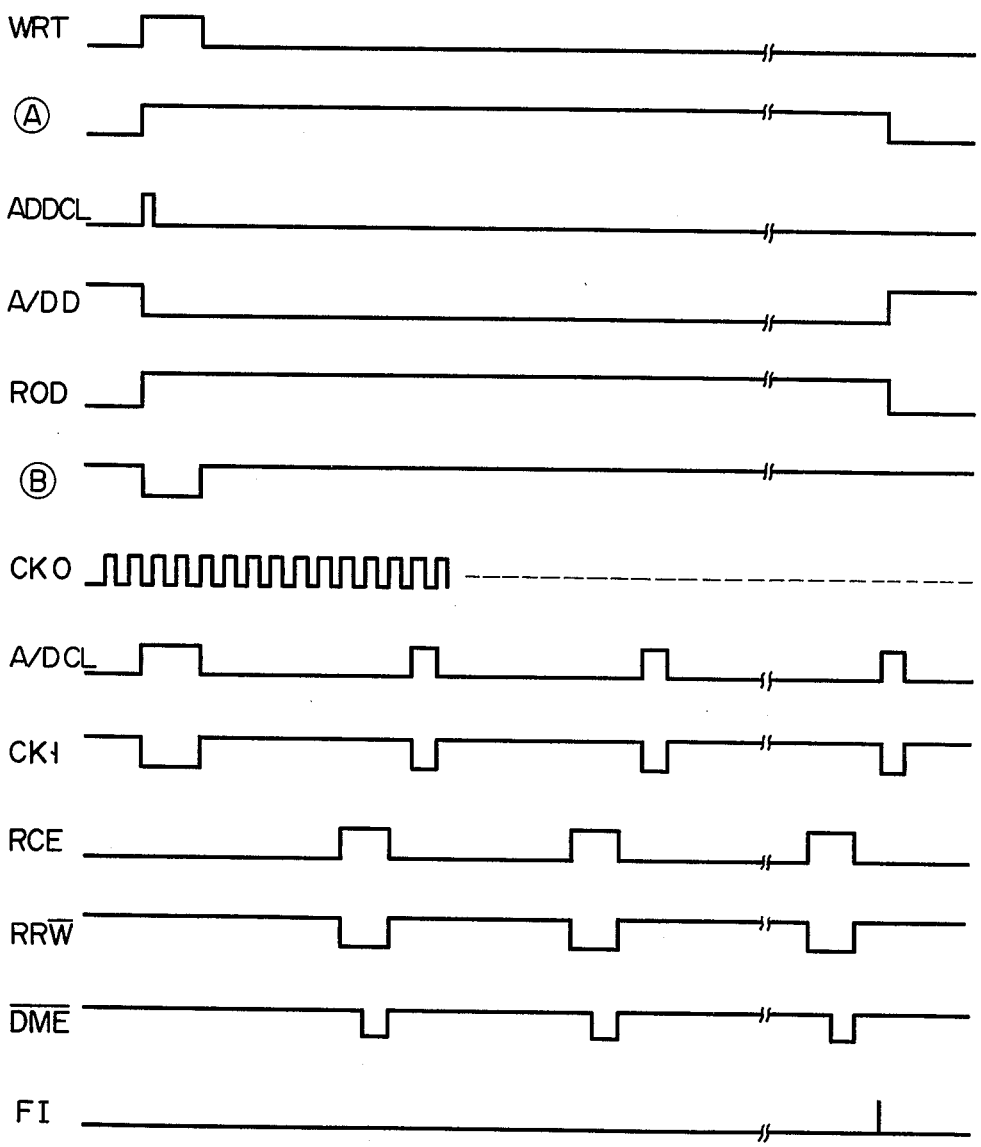
FIG. 9 shows waveforms useful in explaining the operation of the instrument of the invention in a storage mode.

Referring now to FIGS. 8 and 9, there will be described the operation of the electronic musical instrument of the aforementioned construction.

In the panel mode, the panel switch PAS alone is turned on, and the flip-flop circuit 53*h* of the operation control circuit 53 is set to bring the signal PAL to the logic "1" level. In consequence, the flip-flop circuit 64*v* of the control signal generator circuit 64 of FIG. 6 is reset to bring the signals A/D D and ROD to the logic "0" and "1" levels, respectively. As a result, the latch circuit 57*b* is set to a data readout enable state, whereas the memory 60 is set to a data readout disable state. The output pulse CK0 of the oscillator 64*m* is counted by the ring counter 64*l*, and the signals A/D CL, RCE and DME are produced at a period ten times as long as the period of the clock CK0, as shown in FIG. 8. In the panel mode, the output of differentiator 64*i* is normally at the logic "1" level, enabling the AND gate 64*j*. Accordingly, as shown in FIG. 8, the negative-going clock signal CK1 is obtained from the AND gate 64*j* and applied to the address counter 63*b*. Thus, the address counter 63*b* produces the address signal AD0 to AD3 and AD10 and AD11 for operating the multiplexer 54 and the demultiplexer 59. The counter 57*a* and the latch circuit 57*b* for A/D conversion are cleared every time the signal A/D CL goes high, and the A/D output is set at an initial value. Consequently, the output of the D/A converter 58 is also set at an initial value, as shown in FIG. 8. At this point of time, the multiplexed analog signal such as VI1 is applied to the comparator 55, so that the output EQ of the comparator 55 is at the logic "1" level, enabling the oscillator 56. As a result, the clock signals CK2 are applied to the counter 57*a* until the output voltage of D/A converter 58 reaches VI1. The output voltage of D/A converter 58 increases stepwisely for every application of the clock CK2. When the output voltage exceeds or substantially reaches the level of VI1, the output EQ of the comparator 55 is switched to the logic "0" level, thereby holding the count number in the latch circuit 57*b*. The final output voltage of the D/A converter 58 is also held. During the output voltage holding period of the D/A converter 58, the signal DME is brought to the logic "0" level, operating the demultiplexer 59 so as to take out the output voltage VO1 corresponding to the input voltage VI1. Since the memory 60 is brought to the data readout disable state (ROD=0) in the panel mode, the RAM chip enable signal RCE of FIG. 8 does not contribute to the operation. The signal A/D CL is in synchronism with the address conversion of the multiplexer 54 and the demultiplexer 59, so that an analog control information signal is multiplexed every time the A/D converter is cleared, and then demultiplexed after processes of A/D conversion and D/A conversion. Namely, in the panel mode, a performance is given in a control mode set by the control panel section. In such panel mode, the player may set his desired control mode to be stored in the memory.

In the storage mode, one of the panel switches PSS1 to PSS12 is selected, thereby determining a memory block to store the control information set in the panel mode. When one preset switch is operated, the signal APS goes high to set the flip-flop circuit 64*v*. In the storage mode, the write switch WRS is turned on in this state, and thus the signal WRT goes high, as shown in FIG. 9. As a result, the flip-flop circuit 64*d* is set to have its output Q go high, as indicated by A in FIG. 9. The signal ADD CL goes high to clear the address counter 63*b*. The setting operation of the flip-flop circuit 64*d* resets the flip-flop circuit 64*v*. In consequence, as shown in FIG. 9, the signal A/D D goes low to enable A/D conversion, and the signal ROD goes high to bring the memory 60 to the data readout disable state. A signal B , which clears the ring counter 64*l* for a fixed time after the flip-flop circuit 64*d* is set, goes high as shown in FIG. 9 to clear the counter 64*l*. When the counter 64*l* is cleared, the output Q0 or the signal A/D CL goes high. After the clear of the counter 64*l* is released, the signals A/D CL, RCE, DME and CK1 are periodically provided in the same manner as in the panel mode. Since the flip-flop circuit 64*d* is set in the storage mode, the signal RRW is rendered low for a period when the signal RCE is high, as shown in FIG. 9, thereby bringing the memory 60 to the data write enable state. In the storage mode, after the digital conversion for each multiplexed analog signal is finished, a digital value is stored in each location of the memory block of the memory 60 selected by the preset switch, by the functions of the signals RCE and RRW. By means of the address counter 63*b* to count the clock CK1, the addresses of 47 locations of the memory block are designated successively, and all pieces of analog control information of the musical tone control information sources 52 are stored in the 47 locations in the form of digital signal. The address finish signal FI is issued by the AND gate 63*c* connected to the outputs Q4 and Q5 of the address counter 63*b*, whereby the flip-flop circuit 64*d* is reset. When the output Q of the flip-flop circuit 64*d* goes low, the output of inverter 64*x* goes high to set the flip-flop circuit 64*v*. Consequently, as shown in FIG. 9, the signals A/D D and ROD go high and low, respectively.

In the performance mode, the preset switch alone is operated, so that the signal APS goes high to set the flip-flop circuit 64*v*. As a result, the signal A/D D goes high to bring the latch circuit 57*b* to the data readout disable state, while the signal ROD goes low to bring the memory 60 to the data readout enable state. Since the output Q of flip-flop circuit 64*d* is at the low level, the signal RRW is at the high level, bringing the memory 60 to the read mode. In consequence, data are read out successively from 47 locations of the memory block selected by the operated preset switch, and analog-converted by the D/A converter 58. The output voltage signal of the D/A converter 58 is demultiplexed by the demultiplexer 59, and coupled to the corresponding control terminal of the musical tone signal synthesizing circuit. Unless another preset switch is operated, the performance is continued in the control mode based on the data read out of the memory 60.

What is claimed is:

1. An electronic musical instrument, comprising:

keyboard circuit means for producing, in response to a key depression, a key identifying signal corresponding to the note of a depressed key and a trigger signal representing said key depression;

musical tone signal synthesizing circuit means coupled to said keyboard circuit means for producing a musical tone signal in response to said key identifying signal, said musical tone signal being modulated by control waveforms;

at least one source of parameter control analog signals whose magnitudes are changeable;

control waveform generator means for producing and supplying said control waveforms to said musical tone signal synthesizing circuit means to modulate the musical tone signal, said control waveforms having controllable parameters to define the shapes thereof and said control waveform generator means being arranged to produce the control waveforms that are determined by said parameter control analog signals in response to said trigger signal and said parameter control analog signals;

at least one source of analog select signals, the level of each of said analog select signals being selectively set to one of a plurality of levels;

mode changeover means coupled to said musical tone signal synthesizing circuit means for changing the generation mode of the musical tone signal in response to said select signals each of which is an analog signal having a level, said mode changeover means including level detecting means for detecting the levels of said analog select signals to produce digital outputs respectively corresponding to said levels for changing said generation mode of the musical tone signal;

a multiplexer circuit connected to receive said parameter control analog signals and said analog select signals for multiplexing said parameter control analog signals and said analog select signals in a time sharing manner;

conversion means coupled to an output of said multiplexer circuit for effecting conversion between digital and analog signals;

read and write memory coupled to said conversion means through a data bus, said memory means storing, in a write mode, output signals of said multiplexer circuit which have been converted into digital signals by said conversion means and reading out, in a read mode, the stored digital signals to supply them to said conversion means which converts the digital signals into analog signals; and a demultiplexer circuit connected to receive analog signals from said conversion means for demultiplexing and selectively coupling said converted analog signals to said control waveform generator means and to said mode changeover means.

2. An electronic musical instrument according to claim 1, wherein said conversion means includes a first converter connected to said output of said multiplexer circuit for converting output signals of said multiplexer circuit into digital signals sequentially; and a second converter having inputs connected to outputs of said first converter for converting the digital signals provided by said first converter into analog signals sequentially; said first converter including a comparator for comparing the voltage of a multiplexed analog signal from said multiplexer circuit with the output voltage of said second converter, a clock oscillator, and a counter circuit connected to said comparator and clock oscillator for counting clock pulses from said clock oscillator until the output voltage of said second converter substantially reaches the voltage of the multiplexed analog signal from said multiplexer circuit.

3. An electronic musical instrument according to claim 1 further comprising control means coupled to said multiplexer circuit, demultiplexer circuit, conversion means, and to said memory means for setting said electronic musical instrument to one of first, second and third operation modes; wherein, in the first operation mode, said memory means is disabled, the parameter control analog signals and select signals are multiplexed in a time sharing manner by said multiplexer circuit, the multiplexed signals are converted into digital signals by said conversion means, the digital signals are converted into analog signals by said conversion means and the analog signals are demultiplexed by said demultiplexer circuit; in the second operation mode, said memory means is enabled to write input data therein, the analog control signals and select signals are multiplexed in the time sharing manner by said multiplexer circuit, the multiplexed signals are converted into digital signals by said conversion means, and said digital signals are stored in said memory means; and, in the third operation mode, the digital signals are read out of said memory means, the read out digital signals are converted into analog signals by said conversion means, and the analog signals are demultiplexed by said demultiplexer circuit.

4. An electronic musical instrument according to claim 3, wherein said control means includes a plurality of preset switches, a panel switch and a write switch, and sets said electronic musical instrument to the first operation mode in response to the operation of said panel switch, sets said instrument to the second operation mode in response to the operation of one preset switch and said write switch, the digital signals corresponding to a set of analog control signals and analog select signals corresponding to said one preset switch being stored in a memory block of said memory means designated by said preset switch, and sets said instrument to the third operation mode in response to the operation of any one preset switch alone, thereby reading out a digital signal from a memory block designated by the operated preset switch.

5. An electronic musical instrument according to claim 1, wherein said at least one source of a parameter control analog signals comprises potentiometers connected across a power source, and said at least one source of analog select signals comprises a voltage divider network having a plurality of taps and a switch selectively connected to said taps.

6. An electronic musical instrument according to claim 1, wherein said mode changeover means includes means for selecting the waveform of the musical tone signal.

7. An electronic musical instrument according to claim 1, wherein said musical tone signal synthesizing circuit means includes a filter circuit having high-pass, band-pass and low-pass outputs, and said mode changeover means includes means for selecting one of the outputs of said filter circuit.

8. An electronic musical instrument according to claim 1, wherein said level detecting means of said mode changeover means includes a plurality of voltage detectors each comprising a plurality of voltage comparators, each voltage comparator having an input connected to one of said sources of said analog select signals; a voltage divider network having voltage dividing points each connected to another respective input of each of said voltage comparators; and a priority logic circuit connected to outputs of said voltage comparators for producing an output signal at an output among a plurality of outputs in accordance with the voltage level of said at least one select signal source.

9. An electronic musical instrument according to claim 8, wherein said priority logic circuit comprises a plurality of AND gates each having an input connected through an inverter to the output of one of said voltage comparators which is connected to one dividing point of said voltage divider network, and the other another input connected to the output of another of said voltage comparators which is connected to another dividing point adjacent to said one dividing point of the voltage divider network.

10. An electronic musical instrument according to claim 1, wherein said trigger signal represents the time from key depression until key release.

* * * * *

UNITED STATES PATENT AND TRADEMARK OFFICE

CERTIFICATE OF CORRECTION

PATENT NO. : 4,244,259

DATED : January 13, 1981

INVENTOR(S) : Masahiko KOIKE

It is certified that error appears in the above—identified patent and that said Letters Patent is hereby corrected as shown below:

Column 16, line 51, delete "the other".

Signed and Sealed this

*Fourteenth* Day of *July 1981*

[SEAL]

*Attest:*

GERALD J. MOSSINGHOFF

*Attesting Officer*

*Commissioner of Patents and Trademarks*